US008943713B1

(12) United States Patent
Eidson

(10) Patent No.: US 8,943,713 B1
(45) Date of Patent: Feb. 3, 2015

(54) SHOE WITH CONCEALED HEEL STORAGE COMPARTMENT

(71) Applicant: James Eidson, Orange Park, FL (US)

(72) Inventor: James Eidson, Orange Park, FL (US)

( * ) Notice: Subject to any disclaimer, the term of this patent is extended or adjusted under 35 U.S.C. 154(b) by 158 days.

(21) Appl. No.: 13/796,913

(22) Filed: Mar. 12, 2013

Related U.S. Application Data

(63) Continuation-in-part of application No. 12/709,529, filed on Feb. 22, 2010, now abandoned.

(51) Int. Cl.
*A43B 3/00* (2006.01)

(52) U.S. Cl.
CPC ..... *A43B 3/0036* (2013.01)
USPC ..... 36/136

(58) Field of Classification Search
USPC ..... 36/136
See application file for complete search history.

(56) References Cited

U.S. PATENT DOCUMENTS

| | | | | |
|---|---|---|---|---|
| 2,478,411 | A | 8/1949 | Martin | |
| 2,507,991 | A | 5/1950 | Neal | |
| 2,897,609 | A | 8/1959 | Bodkin | |
| 2,904,901 | A | 9/1959 | Goldstein | |
| 3,174,234 | A | 3/1965 | Weitzner | |
| 4,547,982 | A | 10/1985 | Gamm | |
| 5,921,008 | A * | 7/1999 | Ruff | 36/136 |
| 6,094,844 | A | 8/2000 | Potts | |
| 6,195,920 | B1 | 3/2001 | Morris et al. | |
| 6,243,974 | B1 | 6/2001 | Schaj | |
| 6,289,612 | B1 | 9/2001 | Kent | |
| 6,898,875 | B2 | 5/2005 | Ruff | |
| 7,028,422 | B1 | 4/2006 | Lewis | |
| 7,418,793 | B2 | 9/2008 | Dominguez et al. | |
| 2005/0172520 | A1 | 8/2005 | Simmons-Gettig | |
| 2005/0284004 | A1 | 12/2005 | Peters | |
| 2009/0249655 | A1 * | 10/2009 | Portnell | 36/136 |

* cited by examiner

*Primary Examiner* — Marie Bays
(74) *Attorney, Agent, or Firm* — Gold & Rizvi, P.A.; Glenn E. Gold

(57) ABSTRACT

A heeled shoe comprising a lower member (sole) and an upper member. The sole having a foot supporting surface and a ground contacting surface. A concealed storage cavity is formed within a heel portion of the shoe sole, wherein the cavity extends inward from a storage cavity opening edge. A storage access door is pivotally attached to a lower region of the shoe sole and shaped to blend into the heel section of the shoe. The storage access door pivots between an opened configuration and a closed configuration, wherein the opened configuration provides access to the concealed storage cavity and the closed configuration seals the concealed storage cavity. The storage access door is retained in a normally closed position by a door closure retention member until a biasing force is applied to open said storage access door.

20 Claims, 10 Drawing Sheets

SHOE WITH CONCEALED HEEL STORAGE COMPARTMENT

CROSS-REFERENCE TO RELATED APPLICATION

This Patent application is a Continuation-In-Part of U.S. Non-Provisional Utility patent application Ser. No. 12/709,529, filed on Feb. 22, 2010, which is incorporated herein in its entirety.

FIELD OF THE INVENTION

The present invention relates generally to footwear. More particularly, the present invention relates to a wedge heel styled footwear having a concealed, integrated storage compartment for retention of personal items within a heel portion of the wedge heel styled footwear.

BACKGROUND OF THE INVENTION

Whether to provide a hiding place, or to provide a storage compartment for small articles when no other means is available, shoes with hidden compartments have been the subject of previous patents. U.S. Pat. No. 2,478,411, issued to Martin in August 1949, discloses a lady's shoe having a concealed compartment in the heel portion of the shoe.

U.S. Pat. No. 2,507,991, issued to Neal in May of 1950, discloses a wedge type heeled shoe comprising a compartment with a hinged door on the inside sidewall of the shoe, accessible by key or bolt. U.S. Pat. No. 2,897,609, issued to Bodkin in August of 1959, discloses a storage cavity with a hinged door on the bottom of the heel of a shoe.

U.S. Pat. No. 2,904,901, issued to Goldstein in September of 1959, discloses a shoe having a compartment in the heel, incorporating a novel locking mechanism. The compartment is inserted into the heel against the frictional resistance of tongues, which tongues hold the container in a releasable locked position.

U.S. Pat. No. 3,174,234, issued to Weitzner in March of 1965, discloses a shoe heel having a compartment in which a collapsed overshoe is stored. U.S. Pat. No. 4,547,982, issued to Gamm in October of 1985, discloses a wraparound pocket for footwear, comprising a pair of liners, one being an inner liner, the other being an outer liner where one of the liners has a slot provided therein.

U.S. Pat. No. 5,921,008, issued to Ruff in July of 1999, discloses an athletic shoe having a drawer slidably received within a compartment in the heel for storing articles within the heel. U.S. Pat. No. 6,195,920 issued to Morris et al. in March of 2001, discloses athletic footwear having an upwardly raised recess in the sole of the shoe wherein a low friction grind plate with compartment for storing components is formed.

U.S. Pat. No. 6,289,612, issued to Kent in September of 2001, discloses many variations of concealed storage compartments contained within numerous different types of footwear. Said patent discloses storage compartments in the heels and toe portions of lady's footwear, men's boots, men's dress shoes, athletic footwear, and even in-line roller skates, otherwise known popularly as "roller blades" and ice skates. Access to such compartments are depicted as being gained by such means as hinged doors, slideable doors on grooved mechanisms, cap closures, flap openings from the insole of the shoe, entirely removable heels containing a cavity therein, slidable drawers, and cylindrical containers that are either inserted or screwed into the heel portion of the shoe.

U.S. Pat. No. 7,028,422, issued to Lewis in April of 2006, discloses a relatively small, concealed storage cavity formed within the heel portion of a lady's flat type shoe, which is accessible via a flap type mechanism from the insole of the shoe.

None of the above inventions and patents, taken either singly or in combination, is seen to describe the instant invention as claimed. In addition, the present invention is seen to solve many problems that are present in the prior art. Specifically, many of the aforementioned inventions have accessibility problems that the present invention has successfully eliminated. More particularly, the purpose of the present invention is to create a truly concealed, and relatively large storage compartment that is easily assessable while continuing to wear the shoe.

Further, in much of the prior art, the closure portion or door member of the storage compartment comes into direct contact with the ground. With such closure members being in direct contact with the ground, their structural integrity could become compromised by the attendant wear and tear. Also, with a closure portion or door member being in direct contact with the ground, one's personal items could become wet or otherwise soiled.

What is desired is a concealed storage system within at least one shoe, wherein the storage system comprises a storage volume capable of storing certain necessary items, including keys, cash, change, personal identification, credit cards, and the like. The preferred storage system would be aesthetically hidden. The preferred storage system would be designed to minimize contamination from environment during use.

SUMMARY OF THE INVENTION

The basic inventive concept provides a concealed storage compartment within a wedge shaped heel section of a shoe. The exemplary shoe includes a torsional spring to retain a door in a normally closed configuration.

A first aspect of the present invention provides an article of footwear comprising:

a shoe lower member having a ground contacting surface foot receiving surface on an opposite, upper surface and shaped defining a toe section and a heel section;

a shoe upper member extending upward from said shoe lower member, wherein said shoe upper member is shaped to receive a foot of an individual and retain said article of footwear upon said wearer during use;

a concealed storage cavity at least partially defined by a cavity interior surface extending from a storage cavity opening edge inward from a heel end thereof into said shoe lower member;

a storage access door shaped to engage with said storage cavity opening edge and provide a rear surface section of said heel section, said storage access door being pivotally attached to a lower region of said shoe lower member enabling said storage access door to toggle between an opened configuration and a closed configuration, wherein said opened configuration provides access to said concealed storage cavity and said closed configuration seals said concealed storage cavity; and a door closure retention member having a first door closure retention member segment affixed to said storage access door and a second door closure retention member segment affixed to said shoe lower member, wherein said door closure retention member retains said storage access door in a closed configuration until a biasing force is applied to open said storage access door.

In a second aspect, the torsional spring is fabricated comprising a spring coil, a first torsional spring support arm and a second torsional spring support, wherein the first torsional spring support arm is attached to the shoe lower member and the second torsional spring support arm being attached to the shoe upper member.

In another aspect, the door closure retention member comprises a pair of torsional springs.

In yet another aspect, the storage access door further comprises a convex shaped door interior surface, wherein said convex shaped door interior surface increases a total storage volume of said concealed storage cavity.

In yet another aspect, the sole further comprises a concealed finger access formed in said shoe lower member, wherein said concealed finger access is located proximate an edge of said storage access door In yet another aspect, the sole further comprises a foot supporting segment extending along said shoe lower member upper surface from said toe section to said heel section and continuing rearward being cantilevered rearward from said concealed storage cavity.

In yet another aspect, the sole further comprises a concealed finger access formed in said cantilevered portion of said foot supporting segment These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
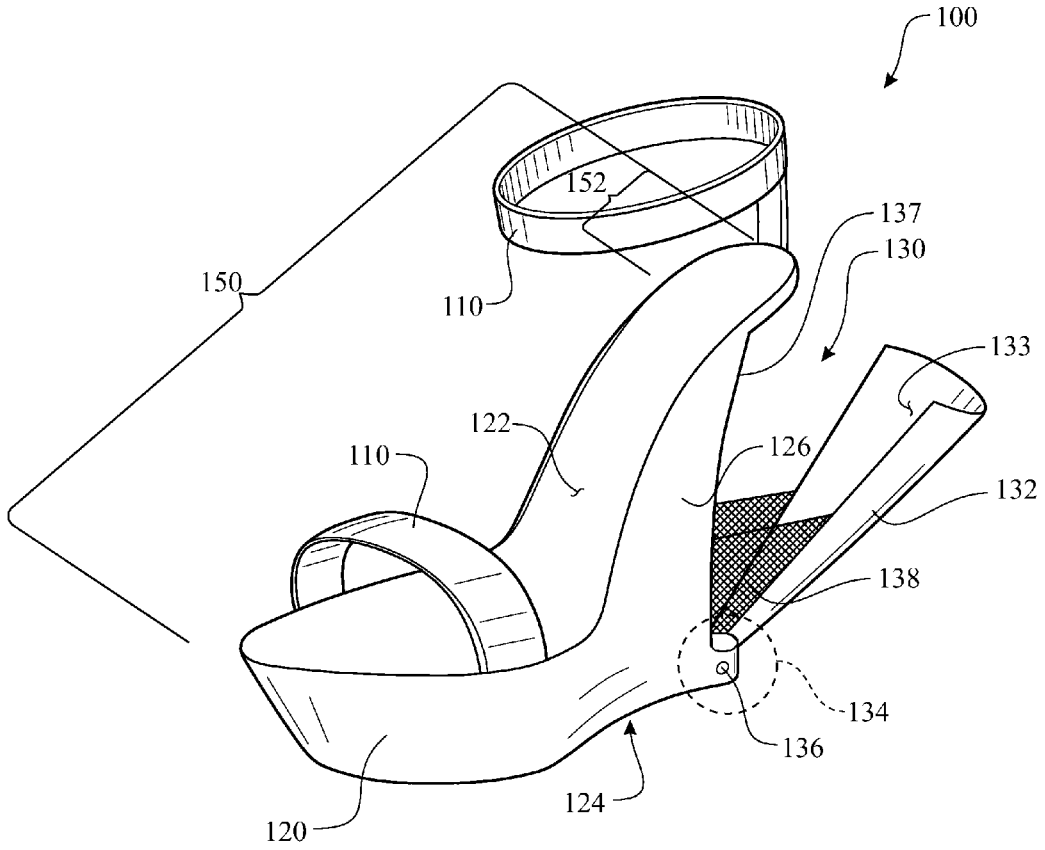
FIG. 1 presents an isometric view of a first exemplary wedge shaped shoe comprising a concealed storage compartment within the heel, wherein a door providing access to the concealed storage compartment is shown in an open configuration.
Figure 2:
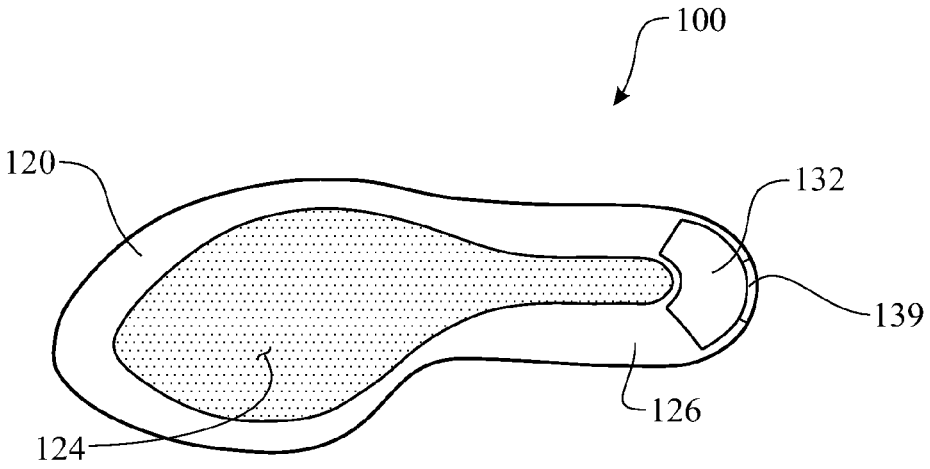
FIG. 2 presents a bottom view of the wedge shaped shoe originally introduced in FIG. 1.
Figure 3:
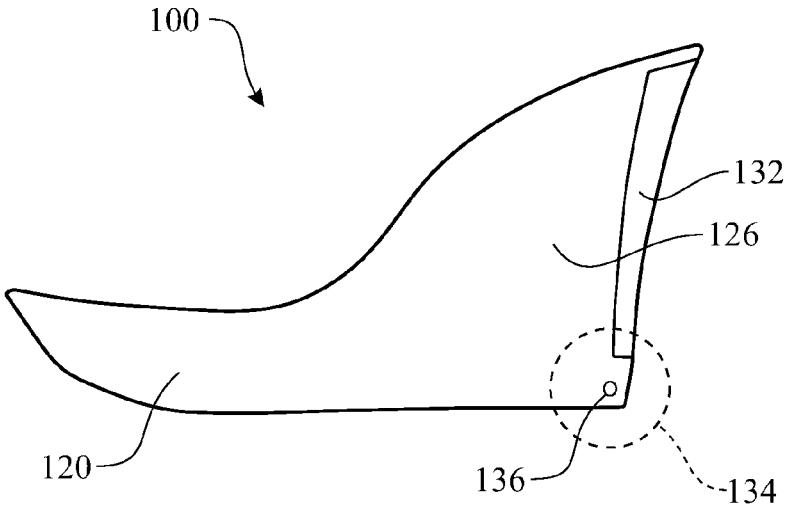
FIG. 3 presents a side elevation view of the wedge shaped shoe originally introduced in FIG. 1, wherein the door providing access to the concealed storage compartment is shown in a closed configuration.
Figure 4:
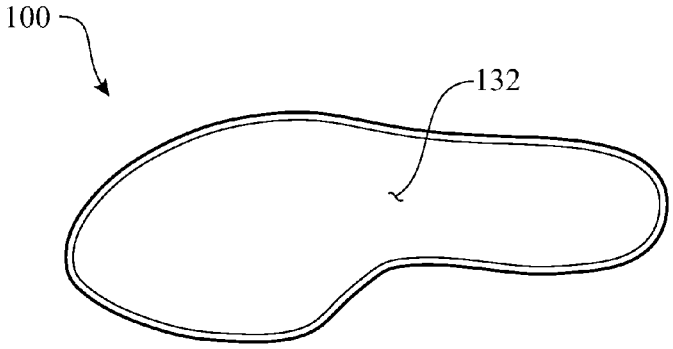
FIG. 4 presents a top view of the wedge shaped shoe originally introduced in FIG. 1.
Figure 5:
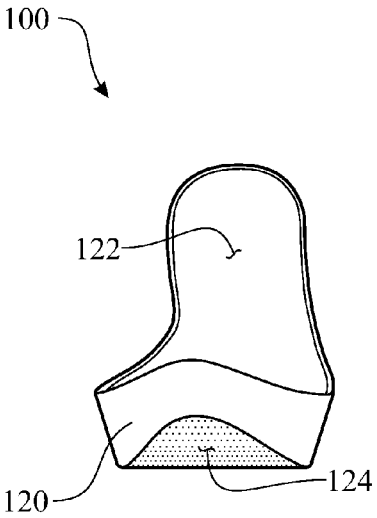
FIG. 5 presents a front elevation view of the wedge shaped shoe originally introduced in FIG. 1.
Figure 6:
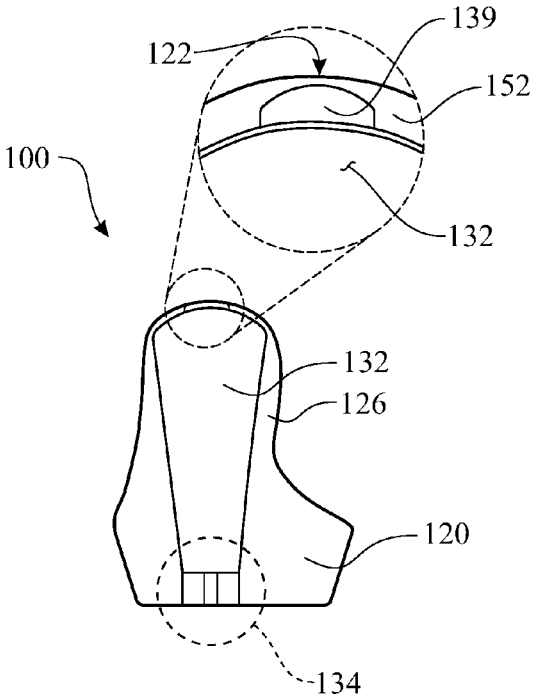
FIG. 6 presents a rear elevation view of the wedge shaped shoe originally introduced in FIG. 1, additionally illustrating a magnified view of a finger access portion thereof.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention provides a concealed, integrated storage compartment 130 within a respective article of footwear 100, 200, 300 as illustrated in FIGS. 1 through 16. The concealed, integrated storage compartment 130 is provided to store and retain personal items such as, but not limited to, paper money, coins, personal identification, small wallets, coin purses, keys, money, credit cards, medication, makeup, mints, tampons, perfume, small cellular telephones, small digital music players, event tickets, contraceptives, jewelry, and the like. The concealed, integrated storage compartment of the present invention provides a convenient manner of storing personal items without the need for traditional article-carrying means such as purses, wallets, tote-bags, clutches, and the like. Moreover, maintaining such personal items in a concealed manner from within the footwear minimizes the chance of attracting criminals who target persons carrying traditional article-carrying means, thereby improving the personal safety of the wearer.

The present invention provides these advantages in virtually any suitable form factor or style of footwear 100, 200, 300 having a shoe heel 126 that is sufficiently sized to integrated the concealed storage cavity 130 of the present invention. The disclosure presents two exemplary form factors, including an open toed shoe 100, 300 having a wedge shaped sole and a boot 200 having a wedge shaped sole 120. Although the disclosure is limited to two exemplary form factors, it is understood that the concealed storage cavity 130 can be integrated into any footwear 100, 200, 300 having a suitably shaped sole 120. Additionally, the concealed storage cavity 130 can be integrated into a single (left or right) shoe 100, 200, 300 or both shoes of a pair of shoes 100, 200, 300.

A women's high heel shoe 100 comprising a concealed storage cavity 130, constructed in accordance with a first exemplary embodiment of the present invention, is illustrated in FIGS. 1 through 8. The high heel shoe 100 is fabricated having a shoe upper member 110 extending generally upwards from a shoe lower member 120. The shoe upper member 110 can be fashioned into any suitable form factor, including a wedge sole shaped shoe or a dress sandal configuration as illustrated, a closed toe configuration, or more specifically, mules, slingbacks, pumps, boots, and the like. The shoe lower member 120 can be referenced having a sole foot receiving surface 122, which contacts a bottom of a wearer's foot and a sole ground contacting surface 124, which contacts the walking surface. It is noted that the sole ground contacting surface 124 is more clearly shown in a bottom view of the high heel shoe 100 illustrated in FIG. 2. A rear portion of the sole foot receiving surface 122 is referred to as a shoe heel 126. The shoe heel 126 is preferably elevated compared to a toe section (forward portion of the shoe lower member 120). A concealed storage cavity 130 is integrated into the shoe heel 126 of the high heel shoe 100. The height of the shoe heel 126 governs a volume of the concealed storage cavity 130. The taller the shoe heel 126, the greater the volume of the concealed storage cavity 130. It is noted that a platform styled lower member 120 can additionally increase the height between the sole ground contacting surface 124 and the sole foot receiving surface 122 near the shoe heel 126, thus increasing the volume and resulting storage capabilities within the concealed storage cavity 130.

The concealed storage cavity 130 includes a cavity interior surface 131 (FIGS. 7 and 8) formed within the shoe heel 126 of the shoe lower member 120. The concealed storage cavity 130 extends inward from a storage cavity opening edge 137 formed about a rear portion of the shoe heel 126. The concealed storage cavity 130 is enclosed by a storage access door 132. The storage access door 132 is pivotally attached to the shoe lower member 120 by a pivot member 136. It is noted that the pivoting section of the concealed storage cavity 130 is generally referred to as a door hinge assembly 134. In one embodiment, the storage access door 132 may be retained in a closed configuration by any of the many commonly known fasteners, including a metal pin, a plastic pin, a metal threaded fastener, a plastic threaded fastener, a rivet, and the like. The shape of the storage access door 132 would be such to match the contour and features of the adjacent edges of the shoe heel 126. A portion of the peripheral edge of the storage access door 132 would align and blend with a storage cavity opening edge 137. The height of the storage access door 132 would be such where an upper edge thereof terminates along a lower surface or edge of a rear extended segment of the sole foot receiving surface 122. This configuration conceals the inclusion of the concealed storage cavity 130 within the high heel shoe 100 and ensures the storage access door 132 is opened only when desired. The storage access door 132 can be shaped to include a door interior surface 133, wherein the door interior surface 133 increases the total volume, wherein said convex shaped door interior surface 133 increases a total storage volume of said concealed storage cavity 130.

The storage access door 132 may be secured in position to close the concealed storage cavity 130 via any number of commonly known closure mechanisms. These may include a snap-type arrangement (i.e. providing snaps and corresponding mating portions on the concealed storage cavity 130 and storage access door 132), inclusion of dense hook and loop tape segments, any suitable spring-loaded arrangement (i.e. providing a spring in conjunction with the hinge for biasing the storage access door 132 into a normally closed position, while enabling a user to draw the storage access door 132 into an open configuration when desired), a magnetically attracting interface and selectively positional hinge arrangements (i.e. providing a hinge capable of "snapping" the storage access door 132 between an open position and a closed position), an elastic material (such as an elastic door retention member 138) spanning between the storage access door 132 and a back wall of the interior storage cavity 131, thereby aiding in maintaining the storage access door 132 in a secure and closed position, and the like. The storage access door 132 is pivotally attached and integrated into the shoe heel 126 by any suitable mechanical design and/or fastener 136, including but not limited to, a metal screw, a plastic screw, a metal pin, a plastic pin, a rivet, and the like.

The storage access door 132 is shaped to increase an overall volume of the concealed storage cavity 130. The shape of the storage access door 132 preferably includes a concave interior surface. The storage access door 132 is pivotally assembled to a lower region of the shoe heel 126 using the pivot member 136 providing selective access to the concealed storage cavity 130.

The shoe lower member 120 can include an upper surface referred to as a foot supporting segment 150. The foot supporting segment 150 is preferably designed to span an entire length of the wearer's foot. Since the foot supporting segment 150 can extend beyond the concealed storage cavity 130, the extended section is referred to as a cantilevered foot supporting section 152. The underside of the cantilevered foot supporting section 152 can be used as an upper portion sealing the concealed storage cavity 130. The peripheral edge of the cantilevered foot supporting section 152 and the outer surface of the storage access door 132 can be shaped to have matching contours. The upper edge of the storage access door 132 would align with the lower edge of the cantilevered foot supporting section 152.

A concealed finger access 139 (FIGS. 2 and 6) can be integrated into the shoe heel 126 providing a clearance for a finger of an individual to aid in gripping a distal end of the storage access door 132 and subsequently opening the storage access door 132. The concealed finger access 139 is best shown in the magnified section view illustrated in FIG. 6. The concealed finger access 139 can be designed to minimize any impact on the aesthetics of the high heel shoe 100.

Figure 7:
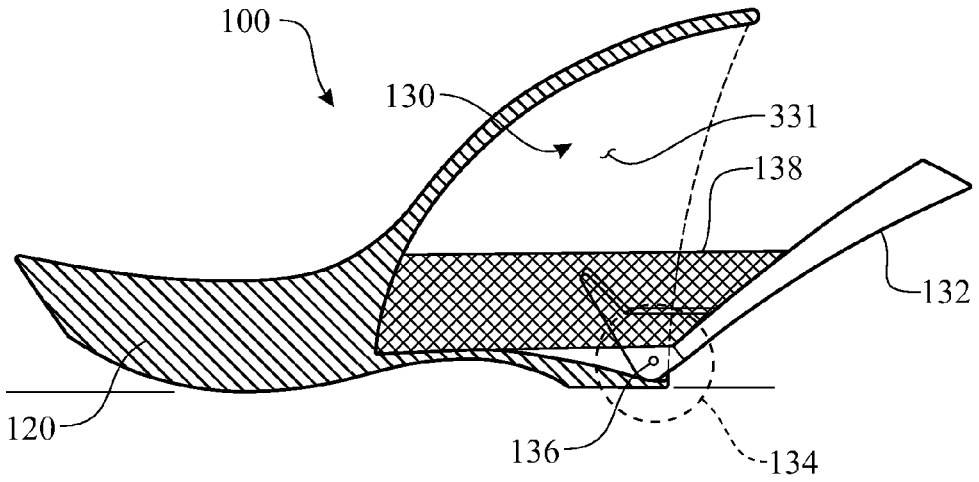
FIG. 7 presents a sectioned side elevation view of the wedge shaped shoe originally introduced in FIG. 1, wherein the door providing access to the concealed storage compartment is shown in an open configuration.
Figure 8:
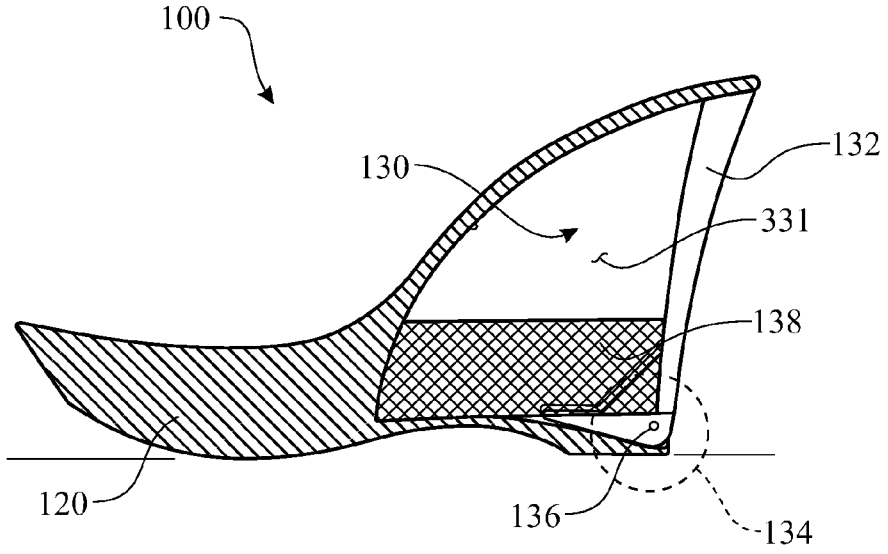
FIG. 8 presents a sectioned side elevation view of the wedge shaped shoe originally introduced in FIG. 1, wherein the door providing access to the concealed storage compartment is shown in a closed configuration.
Figure 9:
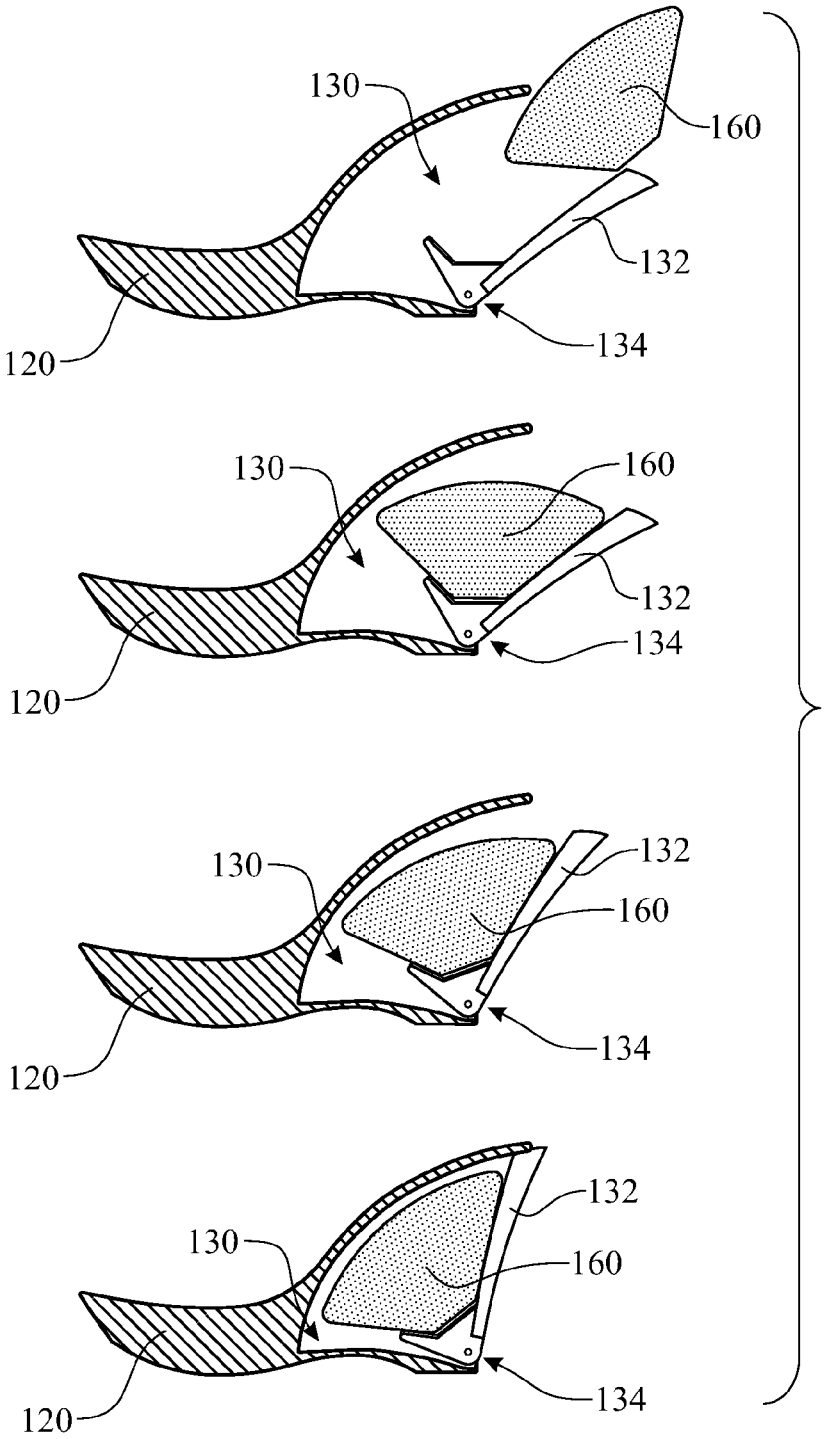
FIG. 9 presents a series of sectioned side elevation views of the wedge shaped shoe originally introduced in FIG. 1, wherein the illustrations present a process of inserting a shaped container within the concealed storage compartment within the heel.
Figure 10:
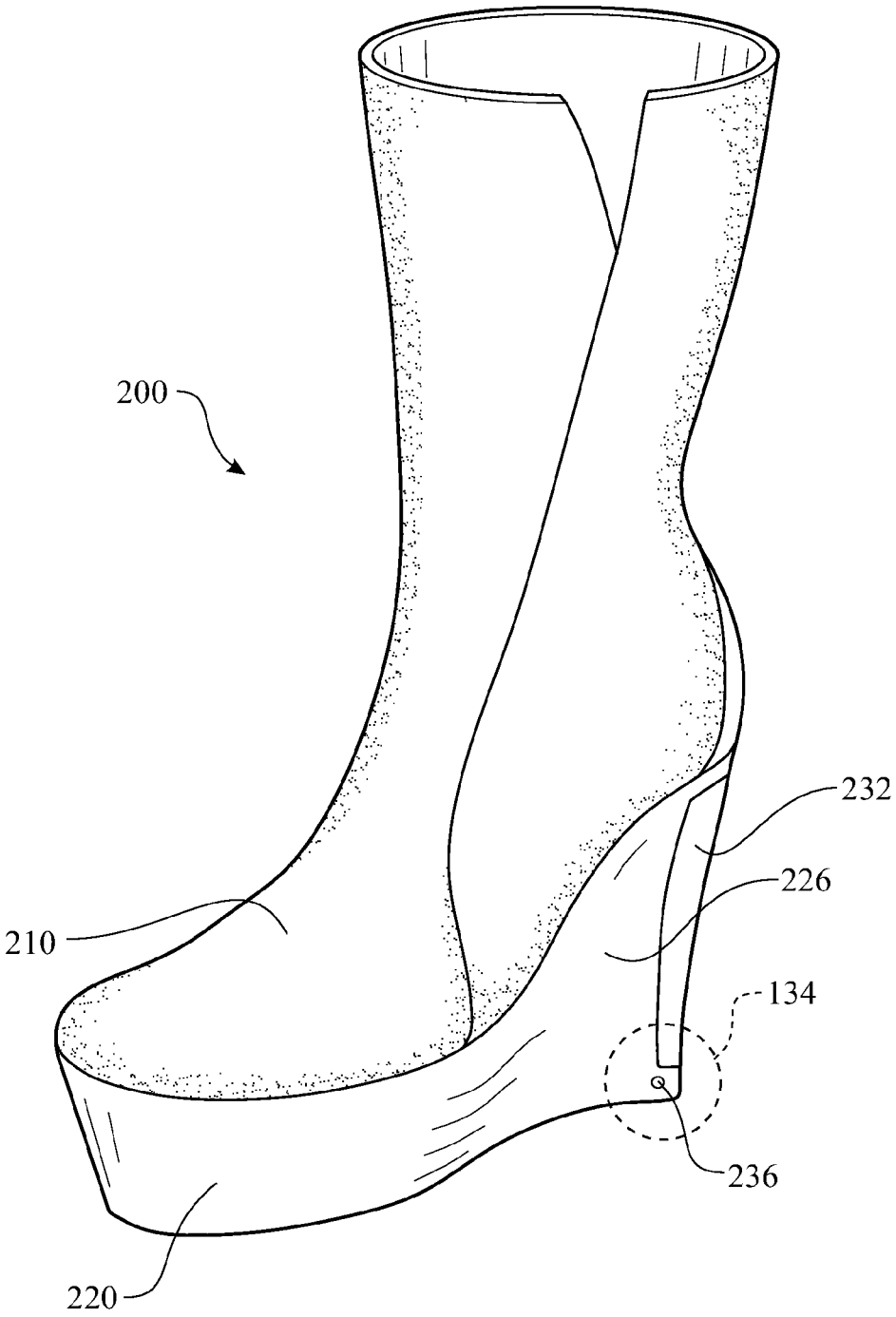
FIG. 10 presents an isometric view of a second exemplary wedge shaped shoe comprising a concealed storage compartment within the heel, wherein a door providing access to the concealed storage compartment is shown in a closed configuration.
Figure 11:
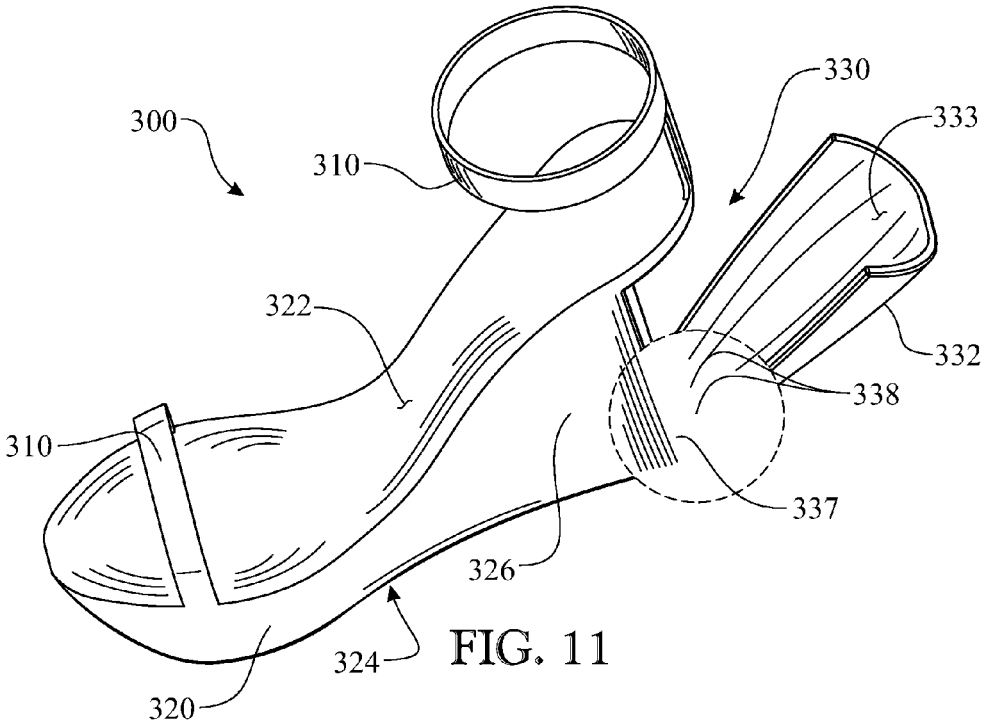
FIG. 11 presents an isometric view of a third exemplary wedge shaped shoe comprising a concealed storage compartment within the heel, wherein a door providing access to the concealed storage compartment is shown in an open configuration.
Figure 12:
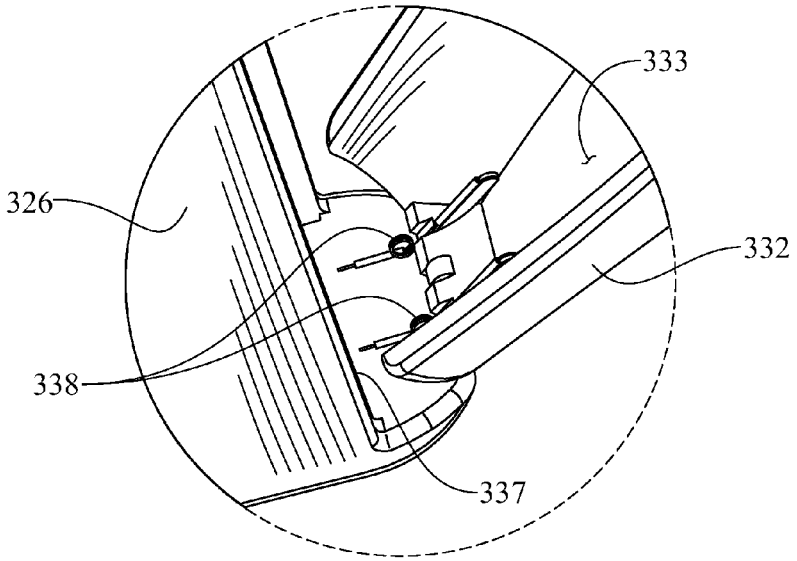
FIG. 12 presents a magnified isometric view of a hinged assembly portion of the wedge shaped shoe originally introduced in FIG. 11.
Figure 13:
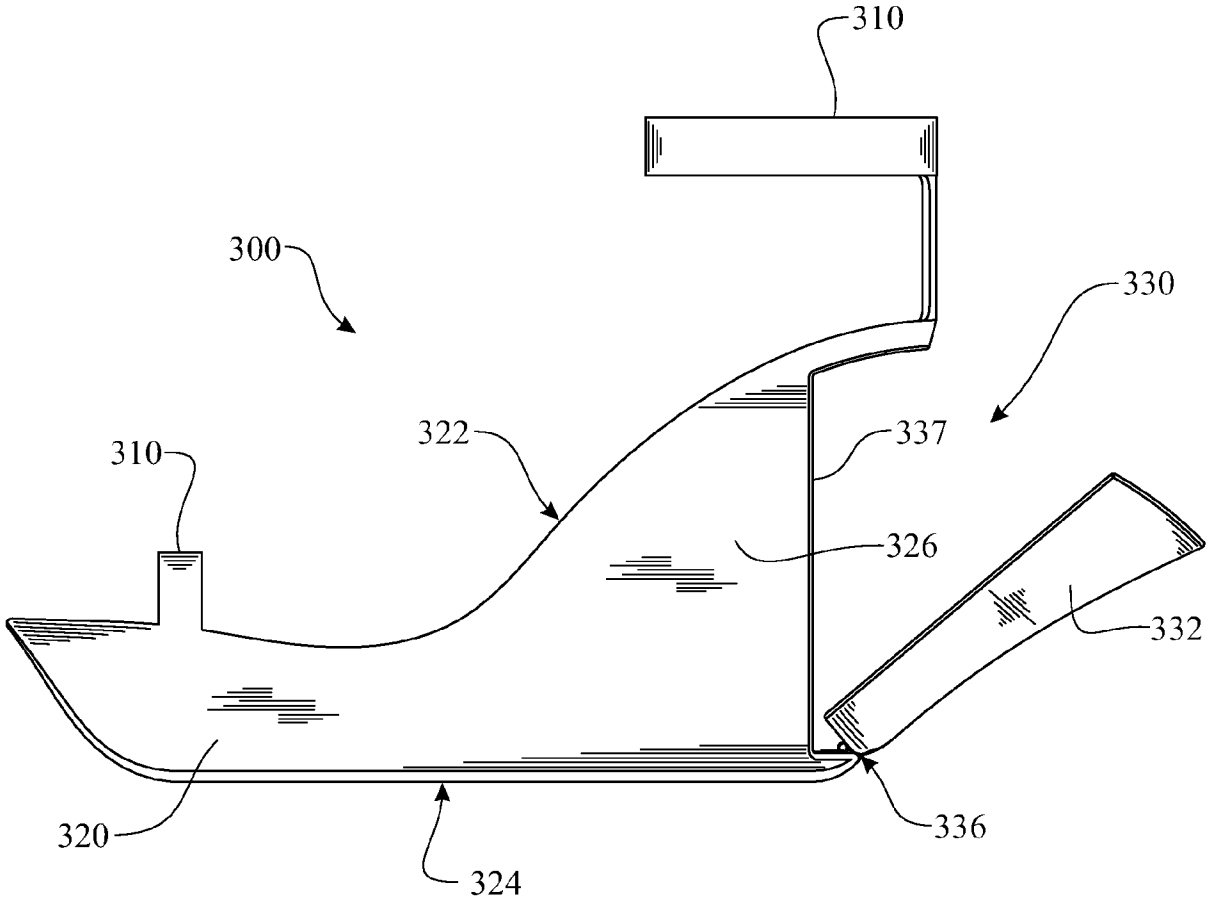
FIG. 13 presents a side elevation view of the wedge shaped shoe originally introduced in FIG. 11, wherein the door providing access to the concealed storage compartment is shown in an open configuration.
Figure 14:
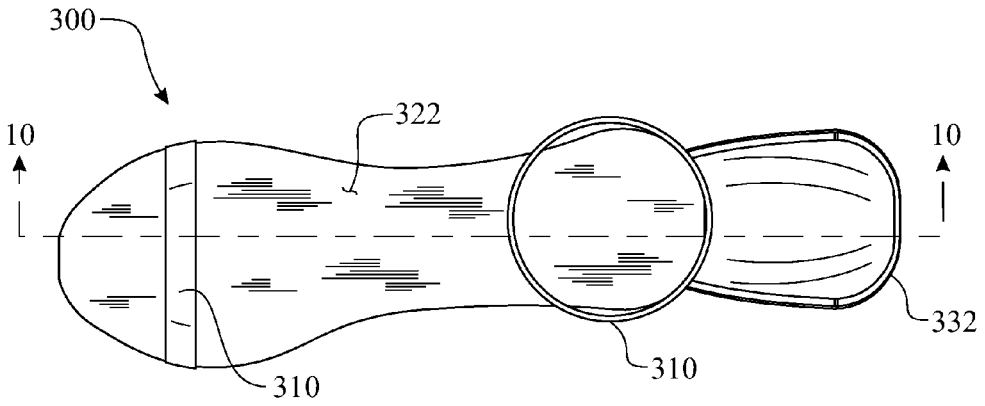
FIG. 14 presents a top view of the wedge shaped shoe originally introduced in FIG. 11, wherein the door providing access to the concealed storage compartment is shown in an open configuration.
Figure 15:
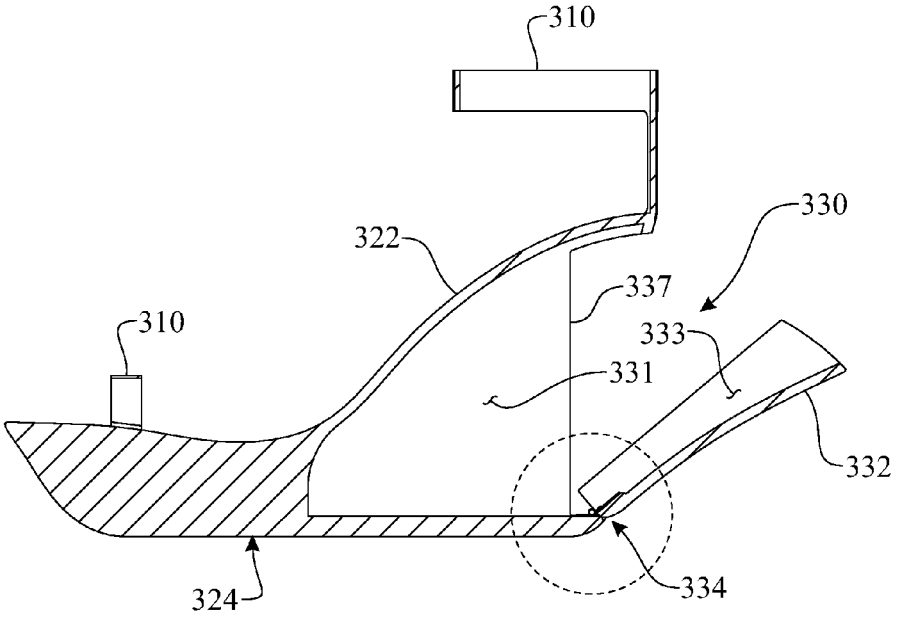
FIG. 15 presents a sectioned side elevation view of the wedge shaped shoe originally introduced in FIG. 11, wherein the door providing access to the concealed storage compartment is shown in an open configuration.
Figure 16:
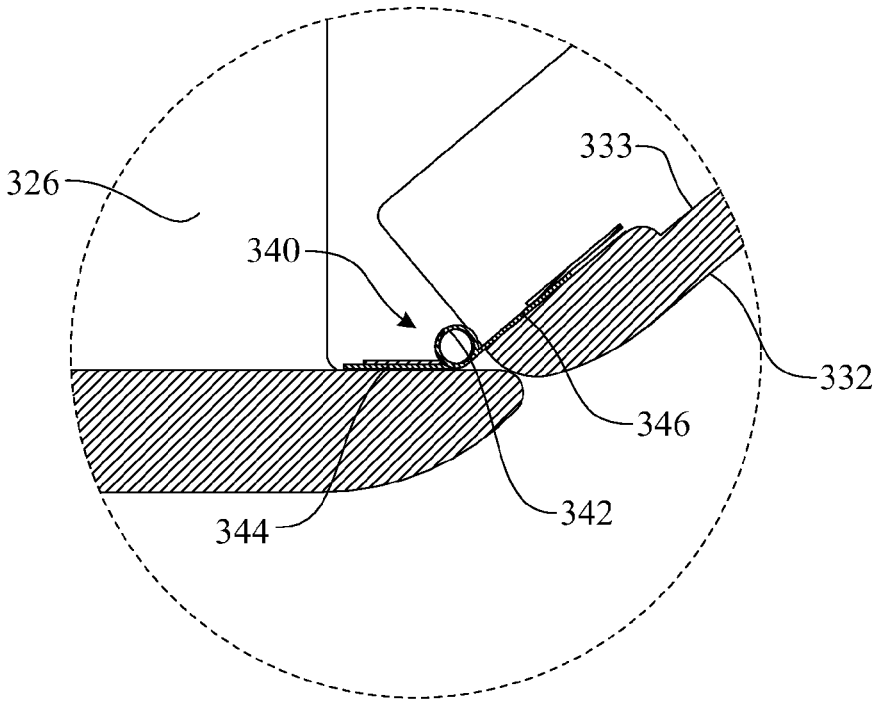
FIG. 16 presents a magnified sectioned side elevation view of the hinged assembly portion of the wedge shaped shoe originally introduced in FIG. 11.

Operation of the storage access door 132 is best presented in the illustrations shown in FIGS. 7 and 8. The storage access door 132 is biased into an open configuration by an individual as illustrated in FIG. 7. The storage access door 132 is biased into a closed configuration by the elastic door retention member 138 as illustrated in FIG. 8. The illustrations present a side section view, more clearly presenting the cavity interior surface 131. Storage of a stored object 160 within the concealed storage cavity 130 is illustrated in a series of illustrations presented in FIG. 9, wherein the storage access door 132 is opened, the stored object 160 is inserted into the concealed storage cavity 130, and the storage access door 132 is closed.

As previously mentioned, the concealed storage cavity 130 can be integrated into any suitable footwear form factor. A second exemplary footwear form factor, more specifically a high heeled boot 200, is presented in FIG. 10. The high heeled boot 200 comprises a series of elements similar to those presented in FIGS. 1 through 9, wherein like features of the high heeled boot 200 and the high heel shoe 100 are numbered the same except preceded by the numeral '2'. The primary difference is the configuration of the shoe upper member 110, wherein the shoe upper member 210 is shaped in a form factor of a boot.

These embodiments, in conjunction with those shown and described above with reference to FIGS. 1-10, should make it perfectly clear to those skilled in the art that accessing the concealed storage cavity 130 of the present invention may be achieved in any number of different fashions without departing from the scope of the present invention.

Figure 17:
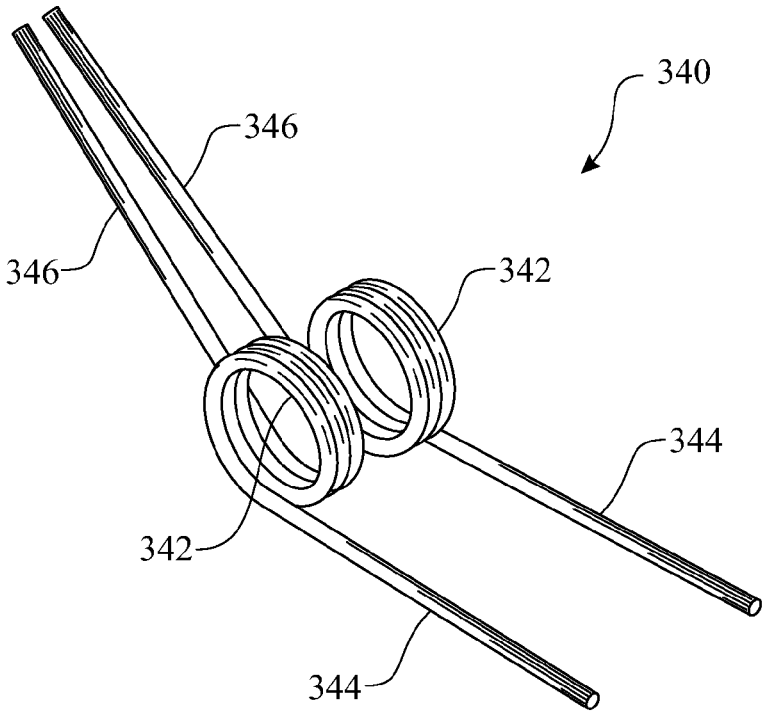
FIG. 17 presents an isometric view of a pair of torsional springs for use within the hinged assembly portion of the wedge shaped shoe originally introduced in FIG. 11.

A third exemplary embodiment is a high heel shoe 300, which is illustrated in FIGS. 11 through 16. The high heel shoe 300 comprises a series of elements similar to those presented in FIGS. 1 through 9, wherein like features of the high heel shoe 300 and the high heel shoe 100 are numbered the same except preceded by the numeral '3'. The elastic door retention member 138 is replaced with a door closure retention member 338. The door closure retention member 338 can be any torsional force application member. In the exemplary embodiment, the door closure retention member 338 is a pair of torsional springs 340, as illustrated in FIG. 17. Each torsional spring 340 is fabricated having a first torsional spring support arm 344 extending from a first end of a spring coil 342 and a second torsional spring support arm 346 extending from a second end of the spring coil 342. The spring coil 342 provides a torsional force between the first torsional spring support arm 344 and second torsional spring support arm 346.

In the high heel shoe 300, the first torsional spring support arm 344 is retained in position against the shoe lower member 320 and the second torsional spring support arm 346 is affixed to a lower end of the storage access door 332. The inclusion of a pair of torsional springs 340 arranged in a mirrored configuration retains an even force distribution to the high heel shoe 300. Each of the torsional spring 340 can be attached to the high heel shoe 300 using any suitable attachment designs, hardware, or combination thereof.

The present invention overcomes the drawbacks of the prior art. By providing a concealed storage cavity within an article of footwear, a wearer can transport and store various personal items without the need for traditional article-carrying means. Women can carry certain personal items (i.e. small wallets, coin purses, money, credit cards, lipstick, keys, tampons, contraceptives, and the like) without the need for a purse, tote bag, clutch, and the like. This reduces the risk of being targeted for theft in that criminals often selects their victims after assessing whether the person is likely to have certain valuables in their possession, which are commonly carried in traditional article-carrying accessories such as purses or wallets. The present invention also provides advantages in terms of convenience by eliminating the need for such traditional article-carrying accessories. This is important for women, for example, in crowded social settings where purses and clutches may be cumbersome and prone to becoming forgotten, lost, or stolen. This is also important for men, for example, who find it frustrating to have to hold their significant other's belongings in such settings.

Further, the present invention resolves many limitations that are present in the prior art. Specifically, a significant number of the cited references have accessibility problems, which are overcome by the present invention. More particularly, the purpose of the present invention is to create a truly concealed and relatively large storage compartment that is easily assessable while continuing to wear the shoe.

Having access the concealed storage compartment while continuing to wear the shoe 100, 200, 300 has many other associated benefits. For instance, the wearer may access the stored items without having to remove the shoe 100, 200, 300; thereby making access in a public forum more convenient and less obvious to onlookers, including would be thieves and criminals. By having access the storage compartment 130 while continuing to wear the shoe 100, 200, 300, the wearer also reduces the chance of touching, or otherwise being exposed to, the various forms of bacteria or viral substances that may be present on the under portion of the shoe 100, 200, 300 that comes into direct contact with the ground. It is noted that shoes 100, 200, 300 often come into direct contact with contaminated floors, such as restroom or lavatory floors, which naturally tend to harbor fecal matter, harmful microorganisms, such as bacteria, viruses, and the like.

In the prior art, the closure portion or door member of the storage compartment comes into direct contact with the ground. With such closure members being in direct contact with the ground, their structural integrity could become compromised by the attendant wear and tear. Also, with a closure portion or door member being in direct contact with the ground, one's personal items could become wet or otherwise soiled.

Moreover, by having a wedge type sole 120 comprising a base several inches high and extending continuously from the toe portion of the upper sole 110 to the heel portion 126 of the upper sole 110, more space is created in the heel portion 126 of the sole 120, which creates a large volume within the concealed storage cavity 130, wherein the larger volume is capable of storing larger personal items 150 such as a wallets, coin purses, makeup, keys, pepper spray, tampons, condoms, etc. By having the storage access door 132 of the concealed storage cavity 130 located on the outer heel portion of the shoe (instead of the interior side wall) said storage access door 132 is less noticeable and more concealed. In addition, the pivot member 136 is integrated into the inside bottom portion of the storage cavity 130 (instead of protruding beyond the door on the side wall of the shoe), thereby remaining less noticeable and more concealed. Furthermore, the present invention has a concealed finger access 139 that assists the wearer in easily opening the storage access door 132. An elastic door retention member 138, 338 affixed to both the door member and a region of the interior storage cavity provides security by ensuring the storage access door 132 of the concealed storage cavity 130 remains tightly closed while the shoe 100, 200, 300 is in use. The storage access door 132 may be secured in position sealing the concealed storage cavity 130 by any number of known closure mechanisms, including but not limited to magnetically attracting pair of components, a snap, a pair of mating dense hook and loop tape segments, a spring loaded arrangement, a selective positional hinge arrangement, and the like.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An article of footwear comprising:

a shoe lower member having a ground contacting surface foot receiving surface on an opposite, upper surface and shaped defining a toe section and a heel section;

a shoe upper member extending upward from said shoe lower member, wherein said shoe upper member is shaped to receive a foot of an individual and retain said article of footwear upon said wearer during use;

a concealed storage cavity at least partially defined by a cavity interior surface extending from a storage cavity opening edge inward from a heel end thereof into said shoe lower member;

a storage access door shaped to engage with said storage cavity opening edge and provide a rear surface section of said heel section, said storage access door being pivotally attached to a lower region of said shoe lower member enabling said storage access door to toggle between an opened configuration and a closed configuration, wherein said opened configuration provides access to said concealed storage cavity and said closed configuration seals said concealed storage cavity; and a door closure retention member having a first door closure retention member segment affixed to said storage access door and a second door closure retention member segment affixed to said shoe lower member, wherein said door closure retention member retains said storage access door in a closed configuration until a biasing force is applied to open said storage access door.

2. An article of footwear as recited in claim 1, wherein said door closure retention member comprises a torsional spring.

3. An article of footwear as recited in claim 2, wherein said torsional spring comprises a spring coil, a first torsional spring support arm and a second torsional spring support, said first torsional spring support arm being attached to said shoe lower member and said second torsional spring support arm being attached to said shoe upper member.

4. An article of footwear as recited in claim 1, wherein said door closure retention member comprises a pair of torsional springs.

5. An article of footwear as recited in claim 1, said storage access door further comprises a convex shaped door interior surface, wherein said convex shaped door interior surface increases a total storage volume of said concealed storage cavity.

6. An article of footwear as recited in claim 1, further comprising a concealed finger access formed in said shoe lower member, wherein said concealed finger access is located proximate an edge of said storage access door.

7. An article of footwear comprising:

a shoe lower member having a ground contacting surface foot receiving surface on an opposite, upper surface and shaped defining a toe section and a heel section;

a shoe upper member extending upward from said shoe lower member, wherein said shoe upper member is shaped to receive a foot of an individual and retain said article of footwear upon said wearer during use;

a concealed storage cavity at least partially defined by a cavity interior surface extending from a storage cavity opening edge inward from a heel end thereof into said shoe lower member;

a foot supporting segment extending along said shoe lower member upper surface from said toe section to said heel section and continuing rearward being cantilevered rearward from said concealed storage cavity;

a storage access door shaped to engage with said storage cavity opening edge and provide a rear surface section of said heel section, said storage access door being pivotally attached to a lower region of said shoe lower member enabling said storage access door to toggle between an opened configuration and a closed configuration, wherein said opened configuration provides access to said concealed storage cavity and said closed configuration seals said concealed storage cavity; and a door closure retention member having a first door closure retention member segment affixed to said storage access door and a second door closure retention member segment affixed to said shoe lower member, wherein said door closure retention member retains said storage access door in a closed configuration until a biasing force is applied to open said storage access door.

8. An article of footwear as recited in claim 7, wherein said door closure retention member comprises a torsional spring.

9. An article of footwear as recited in claim 8, wherein said torsional spring comprises a spring coil, a first torsional spring support arm and a second torsional spring support, said first torsional spring support arm being attached to said shoe lower member and said second torsional spring support arm being attached to said shoe upper member.

10. An article of footwear as recited in claim 7, wherein said door closure retention member comprises a pair of torsional springs.

11. An article of footwear as recited in claim 7, said storage access door further comprises a convex shaped door interior surface, wherein said convex shaped door interior surface increases a total storage volume of said concealed storage cavity.

12. An article of footwear as recited in claim 7, further comprising a concealed finger access formed in said shoe lower member, wherein said concealed finger access is located proximate an edge of said storage access door.

13. An article of footwear as recited in claim 7, further comprising a concealed finger access formed in said cantilevered portion of said foot supporting segment.

14. An article of footwear comprising:

a shoe lower member having a ground contacting surface foot receiving surface on an opposite, upper surface and shaped defining a toe section and a heel section;

a shoe upper member extending upward from said shoe lower member, wherein said shoe upper member is shaped to receive a foot of an individual and retain said article of footwear upon said wearer during use, wherein said shoe upper member is configured in a form factor of one of:

a wedge shaped soled shoe, a woman's dress shoe, a woman's dress sandal shoe, a high heel boot, a mule, a slingback, pump, and platform;

a concealed storage cavity at least partially defined by a cavity interior surface extending from a storage cavity opening edge inward from a heel end thereof into said shoe lower member;

a foot supporting segment extending along said shoe lower member upper surface from said toe section to said heel section and continuing rearward being cantilevered rearward from said concealed storage cavity;

a storage access door shaped to engage with said storage cavity opening edge and provide a rear surface section of said heel section, said storage access door being pivotally attached to a lower region of said shoe lower member enabling said storage access door to toggle between an opened configuration and a closed configuration, wherein said opened configuration provides access to said concealed storage cavity and said closed configuration seals said concealed storage cavity; and a door closure retention member having a first door closure retention member segment affixed to said storage access door and a second door closure retention member segment affixed to said shoe lower member, wherein said door closure retention member retains said storage access door in a closed configuration until a biasing force is applied to open said storage access door.

15. An article of footwear as recited in claim 14, wherein said door closure retention member comprises a torsional spring.

16. An article of footwear as recited in claim 15, wherein said torsional spring comprises a spring coil, a first torsional spring support arm and a second torsional spring support, said first torsional spring support arm being attached to said shoe lower member and said second torsional spring support arm being attached to said shoe upper member.

17. An article of footwear as recited in claim 14, wherein said door closure retention member comprises a pair of torsional springs.

18. An article of footwear as recited in claim 14, said storage access door further comprises a convex shaped door interior surface, wherein said convex shaped door interior surface increases a total storage volume of said concealed storage cavity.

19. An article of footwear as recited in claim 14, further comprising a concealed finger access formed in said shoe lower member, wherein said concealed finger access is located proximate an edge of said storage access door.

20. An article of footwear as recited in claim 14, further comprising a concealed finger access formed in said cantilevered portion of said foot supporting segment.

* * * * *